United States Patent [19]

Horimoto et al.

[11] Patent Number: 4,655,877

[45] Date of Patent: Apr. 7, 1987

[54] ABSORBENT WEB STRUCTURE

[75] Inventors: Koji Horimoto; Yoshinori Morita, both of Iwakuni, Japan

[73] Assignee: Mitsui Petrochemical Industries, Ltd., Tokyo, Japan

[21] Appl. No.: 814,165

[22] Filed: Dec. 23, 1985

Related U.S. Application Data

[63] Continuation of Ser. No. 644,669, Aug. 28, 1984, abandoned, which is a continuation of Ser. No. 398,709, Jul. 15, 1982, abandoned.

[51] Int. Cl.[4] ..... D21H 5/20

[52] U.S. Cl. ..... 162/146; 156/62.2; 162/157.2; 162/158; 162/182; 264/121; 264/126; 428/288; 428/296; 428/361; 428/394

[58] Field of Search ..... 162/146, 157.2, 182, 162/157.3, 157.4, 157.5, 158; 156/62.2; 264/121, 126; 428/361, 394, 288, 296

[56] References Cited

U.S. PATENT DOCUMENTS 3,920,508 11/1975 Yonemori ..... 162/157.5
4,179,543 12/1979 Hawkins ..... 162/157.3

FOREIGN PATENT DOCUMENTS 109606 10/1974 Japan ..... 162/157.5
134903 12/1974 Japan ..... 162/157.5
91333 8/1976 Japan .
88266 7/1978 Japan .
169900 12/1981 Japan ..... 162/157.3

OTHER PUBLICATIONS

McCutcheon's, Detergents & Emulsifiers, North Amer. Ed., 1975 Edition, pp. 22, 155, 252.

*Primary Examiner*—Peter Chin
*Attorney, Agent, or Firm*—Sherman and Shalloway

[57] ABSTRACT

An absorbent web structure composed of a mixture of 5 to 50% by weight of short fibers of a thermoplastic resin rendered hydrophilic with a surface-active agent and 95 to 50% by weight of cellulosic fibers, said thermoplastic short fibers being melt-bonded to impart self-supporting property to the web structure; characterized in that (i) said thermoplastic short fibers are rendered hydrophilic by forming an aqueous slurry of the fibers containing a nonionic surface-active agent and then dehydrating the slurry, and (ii) said nonionic surface-active agent has (a) an HLB value of from 2 to 20 and (b) a melting point equal to, or higher than, the temperature of the slurry at the time of the dehydrating treatment described in (i) above.

4 Claims, No Drawings

ABSORBENT WEB STRUCTURE

This application is a continuation of application Ser. No. 644,669 filed 8/28/84 which is a continuation of Ser. No. 398,709, filed 7/15/82, both now abandoned.

This invention relates to an absorbent web structure which can exhibit desired mechanical strength properties and excellent absorbing properties when used as disposable diapers, sanitary napkins, medical sponges, wound-treating pads, towels, etc.

More specifically, this invention pertains to an absorbent web structure composed of a mixture of 5 to 50% by weight of short fibers of a thermoplastic resin rendered hydrophilic with a surface-active agent and 95 to 50% by weight of cellulosic fibers, said thermoplastic short fibers being melt-bonded to impart self-supporting property to the structure, characterized in that (i) said thermoplastic short fibers are rendered hydrophilic by forming an aqueous slurry of the fibers containing a nonionic surface-active agent and then dehydrating the slurry, and (ii) said nonionic surface-active agent has (a) an HLB value of from 2 to 20 and (b) a melting point equal to, or higher than, the temperature of the slurry at the time of the dehydrating treatment described in (i) above.

Japanese Laid-Open Patent Publication No. 17455/1978 discloses that a three-dimensional absorbent structure is obtained by mixing a cellulosic fibrous material such as wood pulp with fibers of a thermoplastic resin and consolidating the mixture under moderate heat and pressure, and used as disposable diapers, etc. Japanese Laid-Open Patent Publication No. 16611/1980 also discloses that a water-absorbent sheet obtained by dry sheet formation from a mixture of wood pulp, fibers of a thermoplastic resin and a powder of a water-holding polymeric material such as an acrylic acid-grafted polyglucose or saccharose polymer can be used as disposable diapers, etc.

In these techniques, the thermoplastic fibrous material is desirably mixed as uniformly as possible in the wood pulp, and the bonding treatment under heat melts and bonds the thermoplastic fibers and anchors the wood pulp at various points. It is known that such an absorbent web structure has increased entanglement of the individual fibers and excellent shape stability such as elasticity and recovery.

If the amount of thermoplastic short fibers is large in such an absorbent web structure composed of a mixture of short fibers of thermoplastic resin and cellulosic fibers in which the thermoplastic fibers are melt-bonded to impart self-supporting property to the structure, the structure has improved mechanical strength, but cannot avoid a reduction in absorbing properties. The proportion of the thermoplastic short fibers used should therefore be determined depending upon the end uses by considering the mechanical properties and water absorbing properties of the final product.

It is known on the other hand that in order to improve the hydrophilicity of thermoplastic short fibers, their surface is treated with polyvinyl alcohol, polyacrylic acid, etc. (Japanese Patent Publication No. 47049/1977 corresponding to U.S. Pat. No. 3,920,508).

When surface-active agents are spray-coated on these short fibers in order to improve their hydrophilicity, no great difference in the effect of rendering them hydrophilic is seen depending upon the types of the surfactants.

Frequently, these short fibers are handled in the form of an aqueous slurry. In particular, pulp-like short fibers (synthetic pulp) produced by a flashing method are in the form of an aqueous slurry in the final step of their production. It is desirable therefore to improve their hydrophilicity while they are in the form of an aqueous slurry.

If an attempt is made to improve the hydrophilicity of short fibers of thermoplastic resin by adding a surface-active agent to an aqueous slurry of the thermoplastic short fibers and then dehydrating the slurry, it often results in unsatisfactory hydrophilicity or no improvement of hydrophilicity is obtained.

We made investigations in order to overcome these difficulties, and newly found that the type and HLB value of the surface-active agent used, and the relation between the melting point of the surface-active agent and the temperature of the aqueous slurry at the time of dehydration predominantly affect the absorbing properties, particularly the absorbency rate, of an absorbent web structure composed of short fibers of a thermoplastic resin rendered hydrophilic with the surface-active agent and cellulosic fibers, the thermoplastic short fibers being melt-bonded to impart self-supporting property to the structure.

We further studied the relation among these factors, and have now found that an absorbent web structure having much improved absorbing properties can be provided by using short fibers of thermoplastic resin rendered hydrophilic by a surface-active agent which are characterized by the following (i) and (ii).

(i) The thermoplastic short fibers are rendered hydrophilic by first forming an aqueous slurry of the thermoplastic short fibers containing a nonionic surface-active agent and then dehydrating the slurry, and (ii) the nonionic surface-active agent has (a) an HLB of from 2 to 20 and (b) a melting point equal to, or higher than, the temperature of the slurry at the time of dehydration in (i) above.

It is an object of this invention therefore to provide an absorbent web structure which can exhibit desired mechanical strength properties and excellent absorbing properties.

The above and other objects and advantages of this invention will become more apparent from the following description.

The absorbent web structure of this invention is composed of a mixture of 5 to 50% by weight of short fibers of a thermoplastic resin rendered hydrophilic by a surface-active agent and 95 to 50% by weight of cellulosic fibers, the thermoplastic short fibers being melt-bonded to impart self-supporting property to the structure, characterized in that the thermoplastic short fibers satisfy the conditions (i) and (ii).

The melting point of the nonionic surface-active agent used in this invention is determined by JIS K-0064.

The thermoplastic short fibers used in this invention may be obtained by melt-spinning a thermoplastic resin, such as an olefin resin derived from one or more $\alpha$-olefins, for example polyethylene, polypropylene, an ethylene/propylene copolymer, an ethylene/1-butene copolymer or an ethylene/4-methylpentene copolymer, by various methods, and then cutting the resulting filaments. There can also be used split yarns obtained by splitting a film of such a thermoplastic resin as exemplified above, or pulp-like materials (referred to as synthetic pulp) obtained by the flash spinning of the aforesaid thermoplastic resin.

The synthetic pulp is preferred because it has good miscibility with the cellulosic fibers such as wood pulp of the absorbent web structure to provide a uniform mixture. A method for producing synthetic pulp is disclosed, for example, in Japanese Patent Publication No. 47049/1977 cited hereinabove. In the present invention, synthetic pulp treated with polyvinyl alcohol is preferred which is produced by using polyvinyl alcohol in the production of synthetic pulp.

The surface-active agent used in this invention is nonionic, and has an HLB value in the range of 2 to 20. If the HLB value is smaller than 2 or larger than 20, sufficient hydrophilicity cannot be imparted to the thermoplastic short fibers. In order to improve absorbency, therefore, it is essential to use nonionic surface-active agents having an HLB value within the above-specified range as well as to satisfy the melting conditions and hydrophilicity-imparting treating conditions to be described in detail hereinbelow.

Surfactants having an HLB outside the range specified in this invention, such as polyvinyl alcohol, are not used in the absorbency-improving treatment in accordance with this invention. The thermoplastic short fibers used in the hydrophilicity-imparting treatment of this invention in an aqueous slurry may be those which have already been treated with surfactants outside the scope of the nonionic surfactants used in this invention.

It is essential that the melting point (determined by JIS K-0064) of the nonionic surface-active agent used in this invention be equal to, or higher than, the temperature of the aqueous slurry during dehydration in the hydrophilicity-imparting treatment in accordance with this invention.

The synthetic pulp of thermoplastic resin assumes the state of an aqueous slurry of synthetic pulp in the final stage of its production, and is dehydrated. Under manufacturing conditions having good efficiency, the temperature of the aforesaid aqueous slurry is in the range of about 10° to about 50° C. The melting point (JIS K-0064) of the nonionic surface-active agent used in this invention is desirably equal to, or higher than, the temperature of the aqueous slurry during dehydration, and is, for example in the range of about 20° to about 80° C., preferably about 30° to about 80° C., especially preferably at least about 50° C.

Those surface-active agents which have a melting point (JIS K-0064) below the temperature of the aqueous slurry during the dehydrating treatment are liquid in the aqueous slurry, and therefore, their adhesion to the thermoplastic short firbers becomes poor. Consequently, such surface-active agents are liable to escape during the dehydration treatment, and do not easily adhere to the thermoplastic short fibers.

The nonionic surfactant used in this invention meets the above HLB and melting point requirements.

Many surface-active compounds similar to the nonionic surfactants specified in this invention do not come within the range specified in this invention because of differences in molecular weight, degree of polymerization, degree of esterification, etc. Examples of preferred nonionic surfactants used in this invention are shown below, but they must further be screened to conform to the requirements set forth herein.

Polyoxethylene alkyl ethers, polyoxyethylene alkyl phenyl ethers (e.g., polyoxyethylene nonyl phenyl ether), polyoxyethylene fatty acid esters, sorbitan fatty acid esters (e.g., sorbitan monoleate, sorbitan monopalmitate, sorbitan sesquioleate), polyoxyethylene sorbitan fatty acid esters, and glycerin fatty acid esters (e.g., glycerin monostearate). Especially preferred are glycerin fatty acid esters having an HLB of 2 to 6 and a melting point (JIS K-0064) of 40° to 80° C., sorbitan fatty acid esters having an HLB of 2 to 8 and a melting point (JIS K-0064) of 20° to 80° C., and polyoxyethylene alkyl phenyl ethers having an HLB of 8 to 20 and a melting point (JIS K-0064) of 10° to 50° C.

The thermoplastic short fibers used in this invention are prepared by forming an aqueous slurry of the fibers containing a nonionic surface-active agent meeting the requirements given in this invention, and then dehydrating the aqueous slurry. As necessary, the dehydrated product may be dried. The preferred take-up of the surfactant in the resulting thermoplastic short fibers is about 0.1 to about 5% by weight based on the weight of the fibers.

Examples of the cellulosic fibers, the other component of the absorbent web structure of this invention include various wood pulps and regenerated cellulosic fibers such as acetate fibers and viscose fibers.

The absorbent web structure of this invention is composed of a mixture of 5 to 50% by weight of the thermoplastic resin short fibers treated with a nonionic surfactant as stated hereinabove and 95 to 50% by weight of the cellulosic fibers. The absorbent web structure may be obtained by a wet or dry sheet forming process.

The web structure of the invention can be obtained by heating the dry or wet web-like material composed of the above mixture to melt-bond the thermoplastic short fibers.

If the proportion of the thermoplastic short fibers is less than 5% by weight, scarcely any improvement in mechanical strength is obtained by the melt-bonding treatment. If, on the other hand, it exceeds 50% by weight, a reduction in absorbency cannot be avoided.

The melt-bonding treatment of the thermoplastic short fibers can be effected, for example, by using an air oven, an infrared heater, etc. The heating temperature may vary depending upon the type of the thermoplastic resin constituting the thermoplastic short fibers, but is preferably from the melting point of the thermoplastic resin used to a temperature about 50° C. higher than it.

The bulk density of the absorbent web structure of this invention can be adjusted to some extent by the melt-bonding treatment of the thermoplastic short fibers. If desired, products of varying bulk densities can be obtained by performing a moderate press treatment simultaneously with the melt-bonding treatment.

The absorbent web structure of this invention may include another water-holding material in order to improve its absorbency further. For example, fine particles of various polymeric electrolytes can be used as such a water-holding material, as disclosed in the above-cited Japenese Laid-Open Patent Publication No. 16611/1980. Preferred water-holding materials include, for example, polymers resulting from grafting of a vinyl compound, such as acrylic acid or acrylonitrile, which has a hydrophilic group or a group convertible to a hydrophilic group by hydrolysis to polyglucose or saccharose such as wood pulp, cotton or starch, and hydrolysis products of such graft polymers.

The absorbent web structure of this invention has especially good penetrability of an aqueous liquid (absorbency rate), and excellent mechanical properties such as elasticity and recovery. It further has excellent properties suitable for use as disposable diapers, sanitary napkins, medical medical sponges, wound-treating pads, towels, etc. Depending upon the ultimate uses, an outer covering material having reduced water-holding property or a water-impervious lining material may be laminated to the web structure of this invention.

The following examples illustrate the present invention in greater detail.

EXAMPLE 1

Twenty grams of synthetic pulp (average fiber length 0.9 mm) of flash-spun fibers of high-density polyethylene was put in 1 liter of water kept at 40° C., and 150 mg of glycerin monostearate (HLB 3.2; melting point, JIS K-0064, 55° C.) was added. The mixture was stirred to form an aqueous slurry. The aqueous slurry (40° C.) was dehydrated between wire gauzes until its water content was decreased to 30% by weight, and then dried under heat.

The resulting synthetic pulp had 0.75% by weight of glycerin monostearate adhering to its surface.

Twelve grams of the synthetic pulp and 48g of crushed pulp were uniformly mixed, and subjected to a dry sheet forming process to form a web having a basis weight of 375 g/m$^2$. The web was treated in an air oven at 150° C. for 10 minutes to melt-bond the fibers of the synthetic pulp.

In accordance with No. 33-80 "Determination of Water Absorbency Rate of Bibulous Paper (Water Drop Method)" in J. TAPPI Testing Methods for Paper and Pulp, the resulting absorbent web structure was laid horizontally. One cubic centimeter of tap water at 20°±2° C. was added dropwise by means of a syringe. The time required for the water droplets to completely penetrate into the inside of the test sample from its surface was measured. It was 0.7 second.

EXAMPLES 2 TO 6 AND COMPARATIVE EXAMPLES 1 TO 7

Twenty grams of cut fibers of polypropylene (3 denier×5 mm; P-Chop, a trade name for a product of Chisso Co., Ltd.) were put in 1 liter of water kept at 23° C., and 200 mg of each of the surface-active agents indicated in Table 1 was added. The mixture was stirred to form an aqueous slurry. The slurry (23° C.) was dehydrated between wire gauzes until its water content was decreased to 30% by weight, and then dried under heat.

Using the treated cut fibers, a web was produced in the same way as in Example 1. The web was treated in an air oven at each of the temperatures shown in Table 1 for 5 minutes to melt-bond the cut fibers.

The products were tested as in Example 1 for hydrophilic properties, and the results are shown in Table 1.

TABLE 1

| | Surface-active agent | | | | | Time required for water absorption (seconds) After melt-bonding treatment | |
|---|---|---|---|---|---|---|---|
| Run | Type | Form | Melting point (°C.) (JIS K-0064) | HLB | Take-up (wt. %) | at 140° C., 5 min. | at 150° C., 5 min. |
| Ex. 2 | Sorbitan monopalmitate (Nonion PP4 OR) | Solid | 48 ± 3 | 6.7 | 0.92 | 0 | 0 |
| Ex. 3 | Stearyl monoglyceride (Atmos 150) | Solid | 55 ± 5 | 3.2 | 0.70 | 0 | 0 |
| Ex. 4 | POE nonylphenyl ether (Nonion NS220) | Semi-solid | 27 ± 3 | 16.0 | 0.99 | 2 | 7 |
| Ex. 5 | POE nonylphenyl ether (Nonion NS230) | Solid | 38 ± 3 | 17.1 | 0.80 | 3 | 4 |
| Ex. 6 | POE nonylphenyl ether (Emulgen 950) | Solid | 33 ± 3 | 18.2 | 0.82 | 5 | 13 |
| CEx. 1 | Sorbitan sesquioleate (Solgen 30) | Liquid | 1 ± 2 | 3.7 | 0.10 | 27 | 300< |
| CEx. 2 | Sorbitan sesquioleate (Solgen 40) | Liquid | −3 ± 2 | 4.3 | 0.05 | 20 | 300< |
| CEx. 3 | Sorbitan monolaurate (Nonion LP-20R) | Liquid | 10 ± 3 | 8.6 | 0.20 | 300< | 300< |
| CEx. 4 | POE lauryl ether (Emulgen 108) | Liquid | 10 ± 3 | 12.8 | 0.28 | 300< | 300< |
| CEx. 5 | POE nonyl phenyl ether (Nonion NS212) | Liquid | 12 ± 3 | 13.3 | 0.15 | 27 | 300< |
| CEx. 6 | Sorbitan trioleate | Semi-solid | 30 ± 3 | 1.8 | 0.65 | 30 | 300< |
| CEx. 7 | Sodium laurylsulfate | Liquid | 20 ± 3 | 40 | 0.02 | 300< | 300< |

Note:
Ex. = Example;
CEx. = Comparative Example.

What is claimed is:

1. An absorbent web structure obtained by a dry sheet forming process composed of a mixutre of 5 to 50% by weight of short fibers of a thermoplastic resin rendered hydrophilic with a surface acting agent and 95 to 50% by weight by cellulosic fibers, said thermoplastic short fibers being melt-bonded to impart self-supporting property to the web structure; characterized in that (i) said thermoplastic short fibers are composed of flash-spun fibers of an olefin resin and are rendered hydrophilic by forming an aqueous slurry of the fibers containing a nonionic surface-active agent and then dehydrating the slurry at a temperature of the slurry of not more than about 50° C., and (ii) said nonionic surface-active agent has (a) an HLB value of from 2 to 20 and (b) a melting point equal to, or higher than, the temperature of the slurry at the time of the dehydrating treatment in (i) above, and (iii) the time required for water absorption, as determined by J. TAPPI testing methods of said absorbent web structure, is 5 seconds or less after melt-bonding treatment at 140° C. for 5 minutes.

2. The structure of claim 1 wherein the take-up of the nonionic surface-active agent in the thermoplastic short fibers is about 0.1 to about 5% by weight based on the weight of the fibers.

3. The structure of claim 1 wherein the nonionic surface-active agent has a melting point of at least about 50° C.

4. The structure of claim 1 wherein the flash spun fibers are treated with polyvinyl alcohol.

* * * * *